US006409847B2

(12) United States Patent
Kleemann

(10) Patent No.: US 6,409,847 B2
(45) Date of Patent: Jun. 25, 2002

(54) AUSTENITIC NICKEL-CHROMIUM STEEL ALLOYS

(75) Inventor: Willi Kleemann, Moerlenbach (DE)

(73) Assignee: Schmidt & Clemens GmbH & Co., Lindlar (DE)

( * ) Notice: Subject to any disclaimer, the term of this patent is extended or adjusted under 35 U.S.C. 154(b) by 0 days.

(21) Appl. No.: 09/230,417

(22) PCT Filed: Jul. 23, 1997

(86) PCT No.: PCT/EP97/03975

§ 371 (c)(1),
(2), (4) Date: May 10, 1999

(87) PCT Pub. No.: WO98/04757

PCT Pub. Date: Feb. 5, 1998

(30) Foreign Application Priority Data

Jul. 25, 1996 (DE) ..... 196 29 977

(51) Int. Cl.[7] ..... C22C 19/05; C22C 38/44

(52) U.S. Cl. ..... 148/327; 148/442; 148/505; 420/46; 420/47

(58) Field of Search ..... 148/325, 327, 148/442, 505; 420/46, 47

(56) References Cited

U.S. PATENT DOCUMENTS

| | | | | |
|---|---|---|---|---|
| 3,135,602 A | 6/1964 | Eberele | ..... | 75/128 |
| 3,658,516 A | 4/1972 | Hachisu et al. | ..... | 75/128 |
| 3,713,788 A | 1/1973 | Prill et al. | ..... | 29/182.7 |
| 4,077,801 A | 3/1978 | Heyer et al. | ..... | 75/122 |
| 4,302,256 A | 11/1981 | Kenton | ..... | 148/622 |
| 4,313,760 A | 2/1982 | Dardi et al. | ..... | 75/255 |
| 5,310,522 A | 5/1994 | Culling | ..... | 420/585 |

FOREIGN PATENT DOCUMENTS

| | | | |
|---|---|---|---|
| DE | OS 1 233 609 | | 1/1962 |
| EP | 0 246 092 | | 11/1987 |
| EP | 0 391 381 | | 10/1990 |
| GB | 618560 | | 11/1946 |
| JP | 5820732 | | 12/1983 |
| JP | 63297542 | * | 12/1988 |
| JP | 4116141 | * | 4/1992 |
| JP | 4116142 | * | 4/1992 |

* cited by examiner

*Primary Examiner*—Sikyin Ip
(74) *Attorney, Agent, or Firm*—Merchant & Gould P.C.

(57) ABSTRACT

The invention relates to an alloy steel with 0.3 to 1.0% carbon, 0.2 to 2.5% silicon, up to 0.8% manganese, 30.0 to 48.0% nickel, 16.0 to 22.0% chromium, 0.5 to 18.0% cobalt, 1.5 to 4% molybdenum, 0.2 to 0.6% niobium, 0.1 to O.5% titanium, 0.1 to 0.6% zirconium, 0.1 to 1.5% tantalum and 0.1 to 1.5% hafnium, balance more than 20% iron when the cobalt content is at least 10% and more than 30% iron when the cobalt content is less than 10%. The steel is particularly suitable for use as a heat resistant and high hot strength material for parts, in particular pipes, of petrochemical cracking furnaces for the production of ethylene or synthesis gases.

12 Claims, 4 Drawing Sheets

AUSTENITIC NICKEL-CHROMIUM STEEL ALLOYS

FIELD

The invention relates to a heat and creep resistant austenitic nickel chromium alloy steel such as is used in the petrochemical industry.

BACKGROUND

Such alloys require high strength, especially stress-rupture strength, and adequate toughness at the usual operating temperatures, as well as adequate resistance to corrosion.

U.S. patent specification 4 077 801 discloses a molybdenum- and cobalt-free austenitic cast nickel chromium alloy steel with 0.25% to 0.9% carbon, up to 3.5% silicon, up to 3.0% manganese, 8 to 62% nickel, 12 to 32% chromium, up to 2% niobium, 0.05 to less than 1.0% titanium, 0.05 to 2% tungsten and up to 0.3% nitrogen, balance iron, with high stress rupture strength and ductility at high temperatures. This cast alloy has good weldability and is a suitable material for apparatus for hydrogen reforming.

However, problems arise in view of the increasing process temperatures and the resulting reduction in life due to the decreasing creep strength with increasing temperatures and the fall in resistance to carburisation and oxidation.

SUMMARY

The object of the invention is therefore to provide a nickel chromium alloy steel which can also withstand higher operating temperatures while having adequate creep strength together with resistance to carburisation and oxidation.

The achievement of this object is based on the concept of substantially improving the heat resistance of an austenitic nickel chromium alloy steel by means of cobalt and molybdenum together with certain intermetallic compounds. Cobalt improves the stability of the austenitic iron-nickel-chromium primary structure. This is the case particularly when the alloy contains ferrite-stabilising elements such as molybdenum for solid solution hardening.

In particular the invention consists in an austenitic alloy steel with 0.3 to 1.0% carbon, 0.2 to 2.5% silicon, up to 8% manganese, 30.0 to 48.0% nickel, 16.0 to 22.0% chromium, 0.5 to 18.0% cobalt, 1.5 to 4% molybdenum, 0.2 to 0.6% niobium, 0.1 to 0.5% titanium, 0.1 to 0.6% zirconium, 0.1 to 1.5% tantalum and 0.1 to 1.5% hafnium, the ratio of the contents of tantalum and hafnium to the zirconium content being more than 2.4%, and the total content of tantalum, hafnium and zirconium amounting to 1.2 to 3%. When its cobalt content is at least 10% the alloy steel contains more than 20% iron and when its cobalt content is less than. 10% it contains more than 30% iron.

The alloy has an austenitic iron-nickel-chromium or an austenitic iron-nickel-chromium-cobalt primary structure together with a high stress-rupture or creep strength and is resistant to both carburisation and oxidation. Nevertheless a further improvement in the stress-rupture strength is possible if at the expense of its essential constituents the alloy contains 1.5 to 2.5% aluminium and/or the contents of tantalum, hafnium and zirconium satisfy the following condition:

$$[(\%\ Ta)+(\%\ Hf)]/(\%\ Zr)=1.2 \text{ to } 14$$

A particularly satisfactory alloy is one with 0.42% carbon, 1.3% silicon, 0.40% manganese, 34.0% nickel, 19.0% chromium, 3.5% molybdenum, 0.40% niobium, 0.25% titanium, 0.30% zirconium, 0.15% tantalum and 0.80% hafnium, balance iron, or else one with 0.44% carbon, 1.2% silicon, 0.40% manganese, 33.0% nickel, 19.0% chromium, 3.0% molybdenum, 0.40% niobium, 0.20% titanium, 0.15% zirconium, 1.0% tantalum and 0.10% hafnium, balance iron.

Molybdenum improves the stress-rupture strength at intermediate temperatures, while intermetallic carbide phases impart to the iron-nickel-chromium primary structure, which in itself is weak, a high strength at temperatures up to 0.9 times its absolute melting point. Hafnium, zirconium, titanium, tantalum and niobium form primary carbides of the MC type, while chromium, in the presence of molybdenum, forms carbides of the $M_7C_3$ and $M_{27}C_6$ types in the intra- and interdendritic regions.

BRIEF DESCRIPTION OF THE DRAWINGS

The invention will now be described in more detail, by way of example, with reference to some embodiments. In the drawings.

DETAILED DESCRIPTION

The compositions of the alloys tested are given in the following Table I, which shows three conventional alloys 1, 2 and 3, comparative alloys 4 and 6 to 12, and alloys 5 and 13 to 17 in accordance with the invention. In each case the balance of the alloy consists of iron. The alloys were melted in an intermediate frequency furnace and cast in precision casting moulds or using the centrifugal casting process.

The test pieces for the stress rupture tests were made either from the samples precision cast to near final size or by machining from the centrifugally cast pipes. Using these test pieces the stress rupture behaviour was determined in the as-cast state according to ASTM E 139. The results of tests at 1100° C. and two different stresses are collected in the following Table II.

Figure 1:
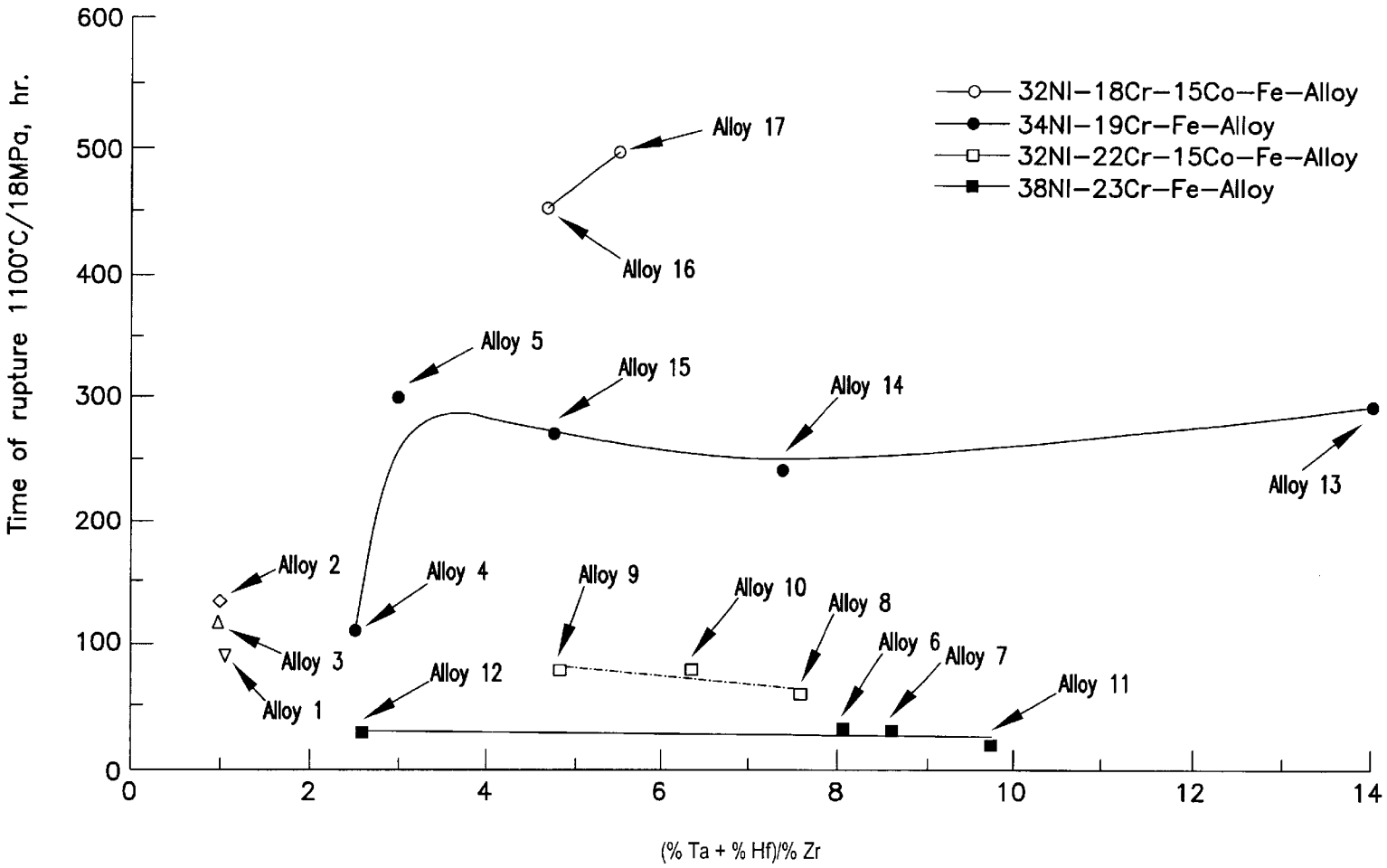
FIG. 1 shows graphically the variation of the time to rupture in stress rupture tests as a function of the total content of hafnium and tantalum in relation to the zirconium content at a temperature of 1100° C. and high stress.
Figure 2:
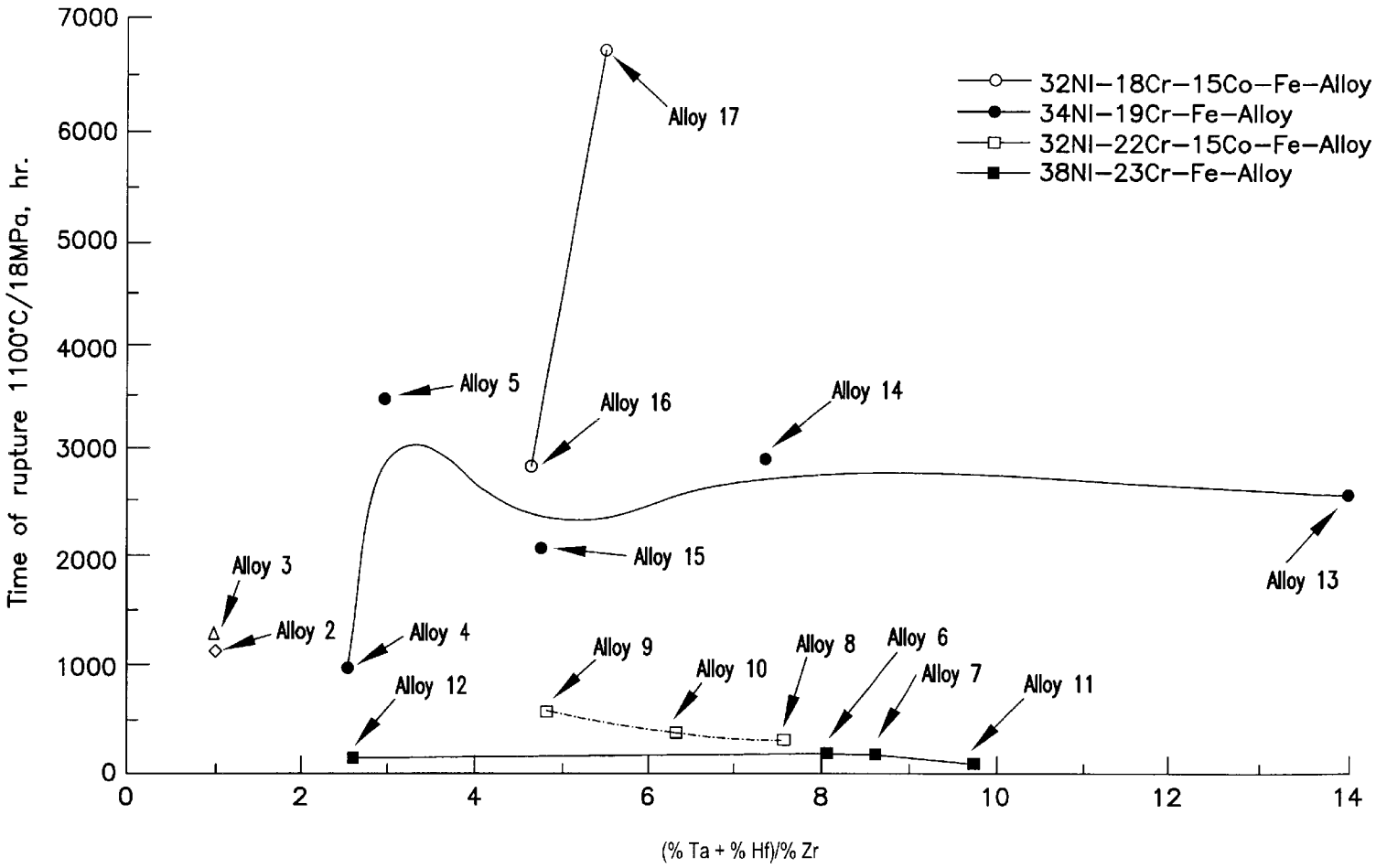
FIG. 2 shows graphically the influence of the total content of tantalum and hafnium on the stress rupture life in relation to the zirconium content at a temperature of 11000° C. and an initial stress of 9.4 MPa.

The data from the stress rupture tests, the minimum creep rate and the time of onset of tertiary creep make it clear that in view of their contents of strong carbide formers the alloys in accordance with the invention are markedly superior to the comparative alloys. Thus the diagrams of FIGS. 1 and 2 demonstrate the clear superiority of the alloys-in accordance with the invention in respect of their stress rupture strength at elevated temperatures as a function of the total content of intermetallic phase forming alloys above a particular level of contents against the background of a particular chromium content, a particular minimum content of nickel, nickel and cobalt, and molybdenum. This shows that the improvement in the stress rupture strength and the creep properties is based on the one hand on the ratio of the total content of tantalum and hafnium to the zirconium content in accordance with the invention, and on the other hand on the influencing of the primary structure by chromium and/or nickel plus cobalt.

To determine the carburisation resistance, samples were tested at 900° C. and at 1000° C. in an atmosphere of hydrogen and propylene in a volume ratio of 89:11, with a volume throughput of 601 ml/min. The amount of carbon pick-up was continuously measured using a microbalance.

Figure 3:
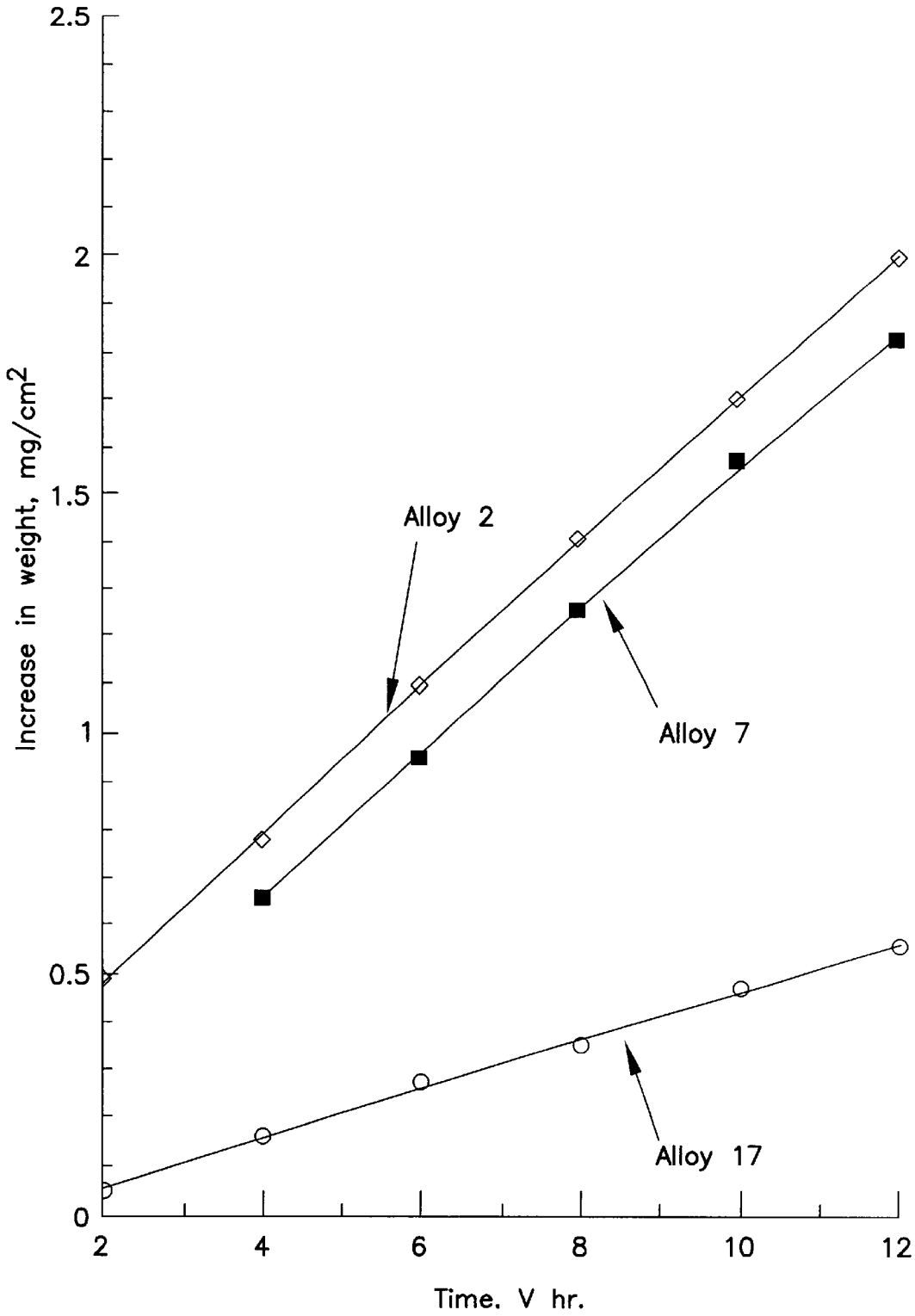
FIG. 3 shows the increase in weight with time in a hydrogen/propylene atmosphere at 1000° C.

The diagram of FIG. 3 shows the results of the measurements and shows parabolic reaction kinetics with the diffusion of carbon as the rate-determining step and a relatively narrow range of increase in weight, with the exception of alloy 17 with an weight increase which is smaller by a factor of almost 4 than in the case of the conventional alloy 2 and the comparative alloy 7. The results of the tests with alloys 4 and 6–12 are evidence of the ineffectiveness of the addition of primary carbide forming elements on the stress rupture properties.

Figure 4:
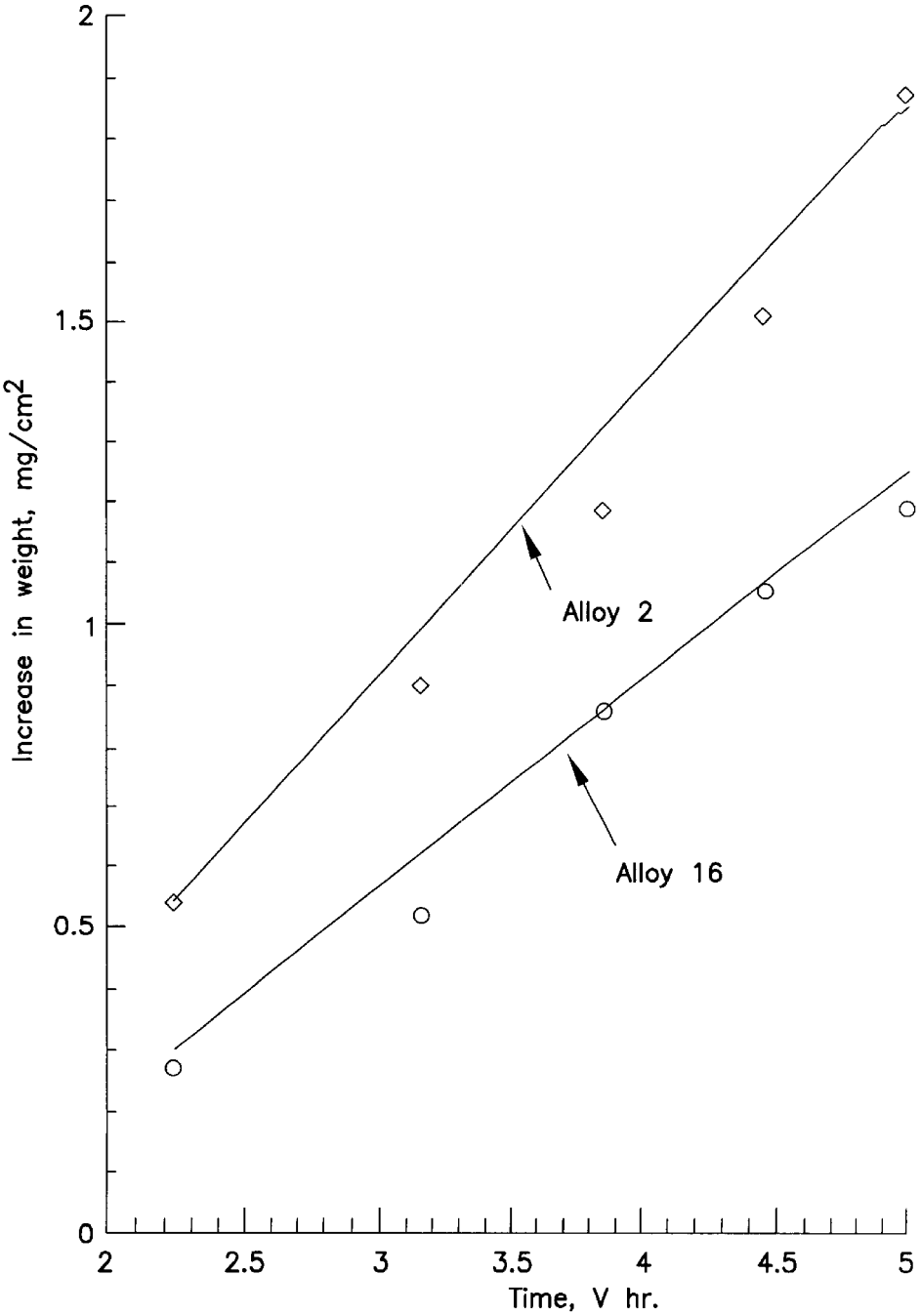
FIG. 4 shows the oxidation resistance of the alloy steel as an increase in weight with time during annealing in air at a temperature of 1050° C.

The results of gravimetric oxidation tests in air at 1050° C., with a test duration of 25 hours, are illustrated by the diagram of FIG. 4 with its likewise parabolic relationship, which makes clear the superior oxidation properties of the test alloy 16 in accordance with the invention compared with the conventional test alloy 2.

TABLE 1

| Alloy No. | 1 | 2 | 3 | 4 | 5 | 6 | 7 | 8 |
|---|---|---|---|---|---|---|---|---|
| Alloy ID | G-4857 | G-4852 micro | G-4857M | 84006/901 | 84006/902 | 84006/903 | 84006/4.1 | 84006/4.2 |
| Melt | 84004-0 | 21/8053/8 | AVA/B/C | 347 | 349 | 351 | 355 | 357 |
| Elements % | | | | | | | | |
| Ni | 33.95 | 33.45 | 33.60 | 34.03 | 33.73 | 37.95 | 39.13 | 31.22 |
| Cr | 24.00 | 24.35 | 23.96 | 19.64 | 19.110 | 23.29 | 23.17 | 23.31 |
| Mo | .54 | .02 | .53 | 3.470 | 3.460 | 3.330 | 3.540 | 3.120 |
| Si | 1.320 | 1.880 | 1.700 | 1.300 | 1.290 | 1.430 | 1.790 | 1.370 |
| C | .46 | .43 | .49 | .42 | .415 | .415 | .435 | .44 |
| Mn | .55 | 1.220 | .61 | .43 | .40 | .38 | .37 | .40 |
| Nb | .40 | .76 | .01 | .43 | .43 | .36 | .41 | .41 |
| Ti | .01 | .08 | .16 | .14 | .26 | .20 | .26 | .21 |
| Co | .00 | .00 | .01 | <.01 | <.01 | <.01 | <.01 | 14.76 |
| Al | .01 | <.02 | .01 | .024 | .034 | .030 | .034 | .027 |
| Ta | .00 | .00 | 00 | .18 | .14 | .78 | .85 | .78 |
| Hf | .00 | .00 | .00 | .093 | .78 | .71 | .87 | .56 |
| Zr | .00 | .01 | .11 | .108 | .310 | .185 | .200 | .177 |
| P | .022 | .017 | .016 | .018 | .019 | .020 | .022 | .020 |
| A | .001 | .008 | .001 | <.005 | <.005 | <.005 | <.005 | <.005 |
| Fe | Bal. | Bal. | Bal. | Bal. | Bal. | Bal. | Bal. | Bal. |

| 9 | 10 | 11 | 12 | 13 | 14 | 15 | 16 | 17 |
|---|---|---|---|---|---|---|---|---|
| 84006/4.3 | 84006/4.31 | 84006/905 | 84006/906 | 84006/907 | 84006/908 | 84006/909 | 84006/9.1 | 84006/9.3 |
| 359 | 365 | 361 | 363 | 367 | 369 | 377 | 379 | 383 |
| 31.60 | 32.15 | 36.76 | 37.24 | 33.27 | 33.24 | 33.01s | 32.31 | 31.29 |
| 22.40 | 23.54 | 23.21 | 34.417 | 19.14 | 19.14 | 19.17 | 18.51 | 17.66 |
| 3.00 | 3.150 | 3.100 | 3.050 | 3.200 | 3.040 | 3.260 | 3.150 | 3.090 |
| 1.420 | 1.940 | 1.380 | 1.300 | 1.350 | 1.210 | 1.380 | 1.240 | .68 |
| .43 | .45 | .445 | .465 | .45 | .44 | .400 | .435 | .420 |
| .40 | .37 | .37 | .37 | .38 | .37 | .41 | .40 | .41 |
| .37 | .40 | .38 | .40 | .35 | .40 | .37 | .39 | .38 |
| .36 | .19 | .17 | .16 | .21 | .17 | .21 | .21 | .26 |
| 4.61 | 15.32 | .51 | .05 | .32 | .03 | <.01 | 15.70 | 14.26 |
| .048 | .028 | .029 | .021 | .024 | .021 | .026 | .028 | 1.650 |
| .71 | 1.030 | .84 | .22 | .97 | 1.010 | .79 | .097 | 1.230 |
| 1.200 | .57 | .68 | .13 | .82 | .12 | .84 | .85 | 1.290 |
| .396 | .253 | .156 | .134 | .128 | .154 | .343 | .392 | .464 |
| .018 | .017 | .019 | .019 | .017 | .016 | .019 | .017 | .018 |
| <.005 | <.005 | <.005 | <.005 | <.005 | <.005 | <.005 | <.005 | <.005 |
| Bal. | Bal. | Bal. | Bal. | Bal. | Bal. | Bal. | Bal. | Bal. |

TABLE 2

| Testparameter | | | 1100° C./9.4 MPa | | |
|---|---|---|---|---|---|
| Alloy No. 1 | Alloy ID G-4857 | Melt 84004-0 | Stress-rupture life, hr. | Min. creep rate, %/hr. | Onset of tert Creep, hr. |
| 2 | G-4852 micro | 21/8053/8 | 1258 | 8.61e-4 | 961.6 |
| 3 | G-4857m | AVA/B/C | 1271 | — | 828.8 |
| 4 | 84006/901 | 347 | 964 | — | — |
| 5 | 84006/902 | 349 | 3470 | 1.29*e-4 | 2493.4 |
| 6 | 84006/903 | 351 | 193.6 | — | — |
| 7 | 84006/4.1 | 355 | 184 | — | — |
| 8 | 84006/4.2 | 357 | 313 | — | — |

TABLE 2-continued

| | | | | | |
|---|---|---|---|---|---|
| 9 | 84006/4.3 | 359 | 584 | — | — |
| 10 | 84006/4.31 | 365 | 384 | — | — |
| 11 | 84006/905 | 361 | 101.2 | — | — |
| 12 | 84006/906 | 363 | 148 | — | — |
| 13 | 84006/907 | 367 | 2497 | — | — |
| 14 | 84006/908 | 369 | 2878 | — | — |
| 15 | 84006/909 | 377 | 2067 | — | — |
| 16 | 84006/9.1 | 379 | 2815.7 | 1.98*e4 | 864.1 |
| 17 | 84006/9.3 | 383 | 6703.8 | 1.12*e4 | 5163.3 |

| 110° C./18 MPa | | |
|---|---|---|
| Stress-rupture life, hr. | Min. creep rate, %/hr. | Onset of tert. Creep, hr. |
| 90.5 | 2.34*e-2 | 42.1 |
| 133.8 | 3.9*e-3 | 117.8 |
| 116.6 | 6.5*e-3 | 59.8 |
| 110.5 | — | — |
| 300.2 | 1.49*e-3 | 205.4 |
| 32.3 | — | — |
| 30.60 | — | — |
| 60.0 | — | — |
| 79 | — | — |
| 79.8 | — | — |
| 19.50 | — | — |
| 28 | — | — |
| 291.1 | — | — |
| 243.3 | — | — |
| 272.1 | — | — |
| 452.5 | 2.43*e-3 | 201.9 |
| 496.7 | 1.46*e-3 | 292.2 |

What is claimed is:

1. Heat resistant and high hot strength austenitic nickel chromium alloy steel with high stress rupture strength and carburisation resistance, consisting essentially of:

0.3 to 1.0% carbon, 0.2 to 2.5% silicon, up to 0.8% manganese, 30.0 to 48.0% nickel, 16.0 to 22% chromium, 0.5 to 18.0% cobalt, 1.5 to 4% molybdenum, 0.2 to 0.6% niobium, 0.1 to 0.5% titanium, 0.1 to 0.6% zirconium, 0.1 to 1.5% tantalum, 0.1 to 1.5% hafnium, balance more than 20% iron when the cobalt content is at least 10%, the ratio of the total content of tantalum and hafnium to the content of zirconium being over 2.4, with a total content of tantalum, hafnium and zirconium of 1.2 to 3.0% and optionally 1.5 to 2.5% aluminum.

2. Alloy according to claim 1 with 0.42% carbon, 1.3% silicon, 0.40% manganese, 34.0% nickel, 19.0% chromium, 3.5% molybdenum, 0.40% niobium, 0.25% titanium, 0.30% zirconium, 0.15% tantalum and 0.80% hafnium, balance iron.

3. Alloy according to claim 1 with 0.44% carbon, 1.2% silicon, 0.40% manganese, 33.0% nickel, 19.0% chromium, 3.0% molybdenum, 0.40% niobium, 0.20% titanium, 0.15% zirconium, 1.00% tantalum and 0.15% hafnium, balance iron.

4. Alloy according to claim 1, wherein the weight ratio of the total content of tantalum and hafnium to the content of zirconium is from 2.5 to 14.

5. An article formed from an alloy consisting essentially of:

0.3 to 1.0% carbon, 0.2 to 2.5% silicon, up to 0.8% manganese, 30.0 to 48.0% nickel, 16.0 to 22% chromium, 0.5 to 18.0% cobalt, 1.5 to 4% molybdenum, 0.2 to 0.6% niobium, 0.1 to 0.5% titanium, 0.1 to 0.6% zirconium, 0.1 to 1.5% tantalum, 0.1 to 1.5% hafnium, balance more than 30% iron when the cobalt content is less than 10%, the ratio of the total content of tantalum and hafnium to the content of zirconium being over 2.4, with a total content of tantalum, hafnium and zirconium of 1.2 to 3.0% and optionally 1.5 to 2.5% aluminum.

6. The article according to claim 5, wherein the article comprises a pipe or a fitting.

7. Heat resistant and high hot strength austenitic nickel chromium alloy steel with high stress rupture strength and carburisation resistance, consisting essentially of:

0.3 to 1.0% carbon, 0.2 to 2.5% silicon, up to 0.8% manganese, 30.0 to 48.0% nickel, 16.0 to 22% chromium, 0.5 to 18.0% cobalt, 1.5 to 4% molybdenum, 0.2 to 0.6% niobium, 0.1 to 0.5% titanium, 0.1 to 0.6% zirconium, 0.1 to 1.5% tantalum, 0.1 to 1.5% hafnium, balance more than 30% iron when the cobalt content is less than 10%, the ratio of the total content of tantalum and hafnium to the content of zirconium being over 2.4, with a total content of tantalum, hafnium and zirconium of 1.2 to 3.0% and optionally 1.5 to 2.5% aluminum.

8. Alloy according to claim 7, with 0.42% carbon, 1.3% silicon, 0.40% manganese, 34.0% nickel, 19.0% chromium, 3.5% molybdenum, 0.40% niobium, 0.25% titanium, 0.30% zirconium, 0.15% tantalum, and 0.80% hafnium, balance iron.

9. Alloy according to claim 7, with 0.44% carbon, 1.2% silicon, 0.40% manganese, 33.0% nickel, 19.0% chromium, 3.0% molybdenum, 0.40% niobium, 0.20% titanium, 0.15% zirconium, 1.00% tantalum, and 0.15% hafnium, balance iron.

10. Alloy according to claim 7, wherein the weight ratio of the total content of tantalum and hafnium to the content of zirconium is from 2.5 to 14.

11. An article formed from an alloy consisting essentially of:

0.3 to 1.0% carbon, 0.2 to 2.5% silicon, up to 0.8% manganese, 30.0 to 48.0% nickel, 16.0 to 22% chromium, 0.5 to 18.0% cobalt, 1.5 to 4% molybdenum, 0.2 to 0.6% niobium, 0.1 to 0.5% titanium, 0.1 to 0.6% zirconium, 0.1 to 1.5% tantalum, 0.1 to 1.5% hafnium, balance more than 20% iron when the cobalt content is at least 10%, the ratio of the total content of tantalum and hafnium to the content of zirconium being over 2.4, with a total content of tantalum, hafnium and zirconium of 1.2 to 3.0% and optionally 1.5 to 2.5% aluminum.

12. The article according to claim 11, wherein the article comprises a pipe or a fitting.

* * * * *